US005903797A

United States Patent [19]

Daniels et al.

[11] Patent Number: 5,903,797

[45] Date of Patent: May 11, 1999

[54] MONITORING CLEANING PERFORMANCE TO PREDICT CLEANER LIFE

[75] Inventors: Matthew P. Daniels, Rochester; Dennis G. Gerbasi, Webster; Thomas A. Prentiss, Fairport; David R. Stookey, Rochester; James J. Teich, Penfield; Bruce E. Thayer, Webster; Moritz P. Wagner, Walworth; Ralph J. Weber, Fairport, all of N.Y.

[73] Assignee: Xerox Corporation, Stamford, Conn.

[21] Appl. No.: 08/911,244

[22] Filed: Aug. 15, 1997

[51] Int. Cl.[6] ..... G03G 21/00

[52] U.S. Cl. ..... 399/34; 399/71

[58] Field of Search ..... 399/354, 353, 399/349, 343, 72, 71, 49, 34, 24; 430/125; 15/1.51, 256.5, 256.51, 256.52, 256.6; 324/71.1, 452

[56] References Cited

U.S. PATENT DOCUMENTS

| | | | |
|---|---|---|---|
| 4,967,238 | 10/1990 | Bares et al. | 399/34 |
| 5,119,132 | 6/1992 | Butler | 399/49 |
| 5,128,725 | 7/1992 | Frankel et al. | 399/353 X |
| 5,153,658 | 10/1992 | Lundy et al. | 399/353 |
| 5,546,177 | 8/1996 | Thayer | 399/353 |
| 5,652,945 | 7/1997 | Thayer et al. | 399/34 |
| 5,655,204 | 8/1997 | Siegel | 399/349 |
| 5,729,815 | 3/1998 | Lindblad et al. | 399/354 |

FOREIGN PATENT DOCUMENTS 58-169155 10/1983 Japan .

*Primary Examiner*—Shuk Lee
*Assistant Examiner*—Sophia S. Chen

[57] ABSTRACT

A method, apparatus and printing machine are disclosed that contain a monitoring system that includes a sensor and artificial stress conditions to determine the cleaner brush life. A comparative analysis is performed from the data provided by the monitoring system of a normal cleaning residual toner particle mass and artificial stress conditions cleaning residual toner particle mass to predict brush cleaner life reliably.

25 Claims, 4 Drawing Sheets

MONITORING CLEANING PERFORMANCE TO PREDICT CLEANER LIFE

BACKGROUND OF THE INVENTION

This invention relates generally to an electrostatographic printer and copier, and more particularly, a cleaner with a changing bias to monitor cleaning performance and to predict cleaner life.

Brush cleaners operate by removing the toner from the photoreceptor both with mechanical and/or electrostatic forces. The fibers on the brush touch the untransferred toner and the toner is removed from the photoreceptor onto the brush. The toner on the brush is then transported to a detoning device (e.g. flicker bar, detoning roll, air system, combs, etc.) removing the toner from the brush (i.e. detoned). An electrostatic brush cleaner removes the toner primarily with electrostatic forces. For a dual electrostatic brush cleaner, negative toner is removed with a positively biased brush and positive toner is removed with a negatively biased brush. Dual electrostatic brush cleaners are used in high volume full color single pass 101 (Image on Image) printers.

Unreliable predictions of cleaning performance failure in a cleaning system causes down time and customer dissatisfaction. A highly reliable method or apparatus of predicting cleaner performance is needed, especially in high volume full color single pass 101 printers. Down time could be minimized by the ability to accurately predict cleaner brush life.

The following disclosures may be relevant to various aspects of the present invention and may be briefly summarized as follows:

U.S. Pat. No. 5,546,177 to Thayer discloses a method and apparatus for monitoring the performance of a cleaner brush used to clean a photoreceptive surface. The apparatus and method include developing a toner patch of known first length on the imaging surface and then removing that toner patch from the imaging surface using a cleaner brush that accumulates a toner patch of a second length on the surface of the brush. The comparison of the toner patch on the imaging surface versus the toner patch on the brush surface monitor the cleaning efficiency of the cleaner brush.

U.S. Pat. No. 5,153,658 to Lundy et at. discloses a process for controlling the amount of film buildup on a photoreceptor surface caused by certain print mode and/or material throughput conditions in a single pass highlight color printer which enables or promotes photoreceptor filming by the DAD toner additive (i.e. zinc stearate). Such filming results in the tri-level Image Push defect. This process utilizes toner coated cleaner brushes to control the film buildup thus preventing the defect. This process defines a functional equation that maintains a toner concentration at the cleaner brush fiber tips thereby controlling photoreceptor filming.

U.S. Pat. No. 5,119,132 to Butler discloses an invention that relates generally to an electrographic apparatus and more specifically to an improved structural arrangement in electrographic apparatus of the type having a densitometer, which arrangement achieves improved measuring of marking particle density on a photoreceptor or the like. Wherein, use of a charge-coupled device (CCD) allows for a pixel-by-pixel recordation of the photo intensity reflected off of the photoreceptor and toner test patch. Therefore, as a result of the increased sensitivity of the toner measuring, it is possible to measure denser patches of toner, both black as well as color. Thus, allowing for accurate monitoring of the mount of toner capable of being placed onto a photoreceptor.

SUMMARY OF INVENTION

Briefly stated, and in accordance with one aspect of the present invention, there is provided a method for monitoring performance of a cleaner system removing particles from a surface of the photoreceptor, under artificial stress conditions to determine brush life, comprising: enabling a monitoring member of the cleaner system; creating the artificial stress conditions for the cleaner system in a non-printing area of the photoreceptor; running the cleaner system to remove toner particles from the non-printing area of the photoreceptor under the artificial stress conditions; and using the monitoring member to determine a level of cleaning under the artificial stress conditions.

Pursuant to another aspect of the present invention, there is provided an electrostatographic printing machine comprising: a charge retentive surface, capable of movement, advances past a charging station for charging of the charge retentive surface; an exposure station through which the charge retentive surface moves, the charge retentive surface having charged portions being exposed to a scanning device that discharges the charge retentive surface forming a latent image thereon; a development station advances toner particles into contact with the latent image on the charge retentive surface as the charge retentive surface moves through the development station; a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on the charge retentive surface after transfer, the cleaning station including: a monitoring system to determine a level of cleaning performance of a cleaning means under artificial stress conditions.

Pursuant to another aspect of the present invention, there is provided an apparatus for removing particles from a charge retentive surface, comprising: means for cleaning particles from a charge retentive surface; and a monitoring system to determine a level of cleaning performance of the cleaning means under artificial stress conditions.

BRIEF DESCRIPTION OF THE DRAWINGS

Other features of the present invention will become apparent as the following description proceeds and upon reference to the drawings, in which.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 4:
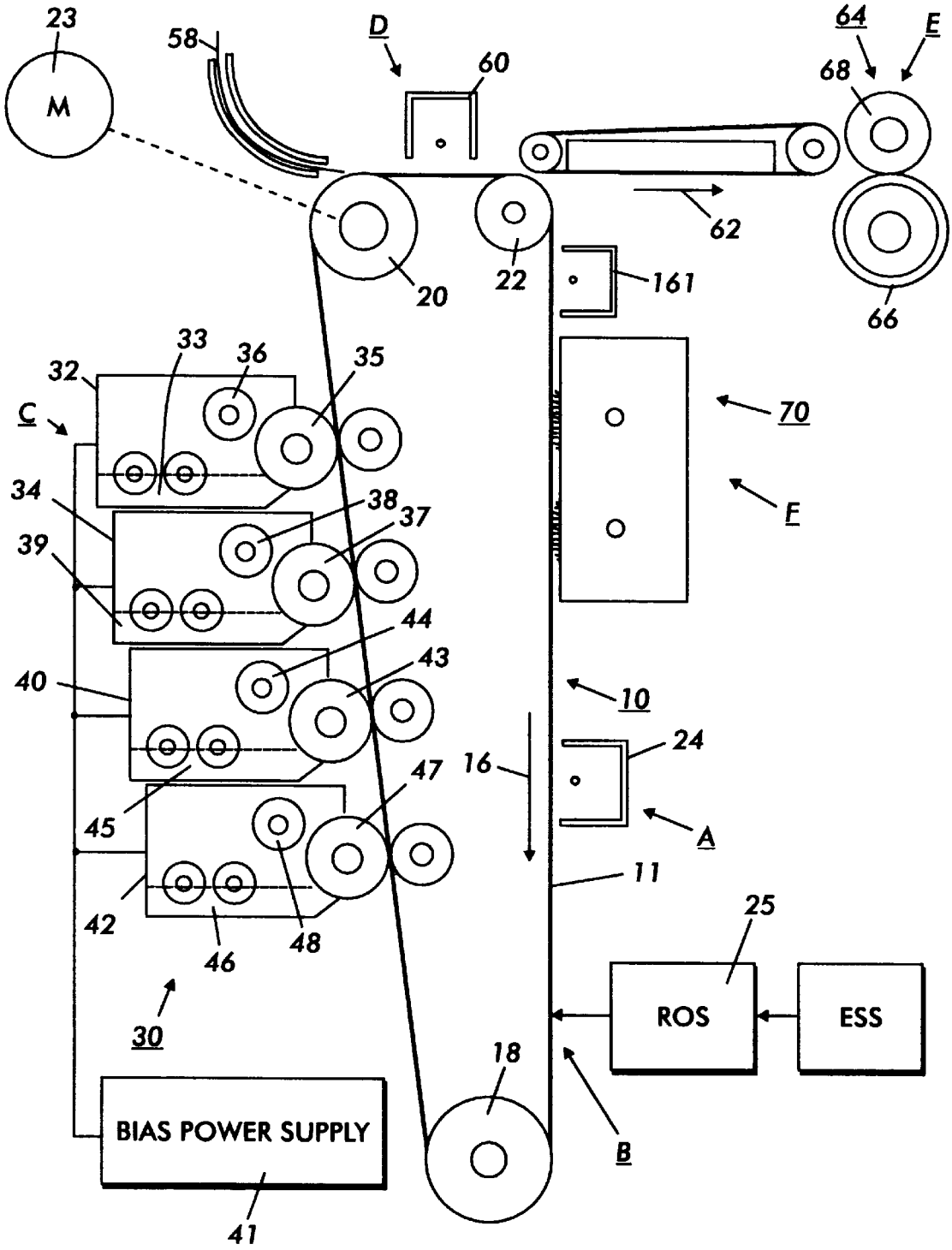
FIG. 4 is a schematic illustration of a printing apparatus incorporating the inventive features of the present invention. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Referring now to the drawings, where the showings are for the purpose of describing a preferred embodiment of the invention and not for limiting same, the various processing stations employed in the reproduction machine illustrated in FIG. 4 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 4, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. A preclean corotron 161 is located upstream from the cleaning system 70.

Figure 1:
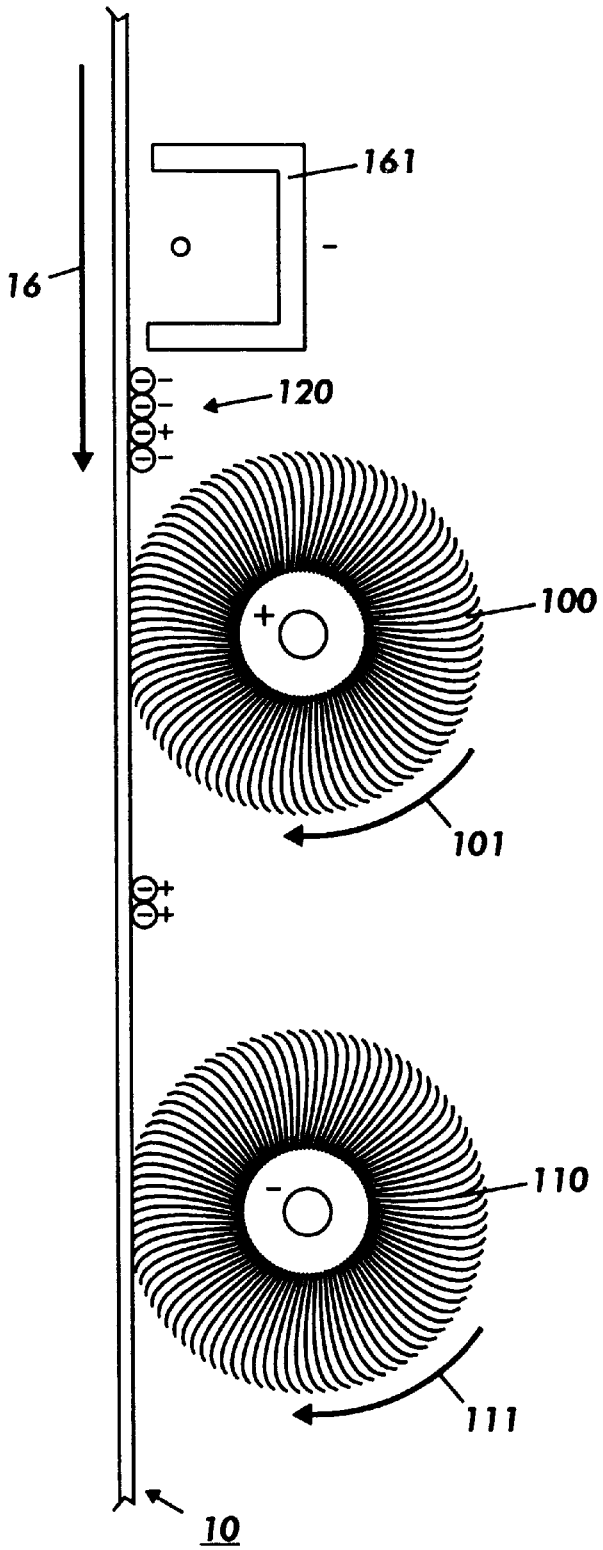
FIG. 1 PRIOR ART
FIG. 1 is an elevational schematic of a prior art dual cleaner brush system designed to remove the majority of the toner particles from the photoreceptor with the first cleaner brush.

Reference is now made to FIG. 1, which shows the prior art of a dual electrostatic brush cleaner. The toner particles used in a DAD (Discharge Area Development) xerographic process are shown here as negatively charged. The majority of the toner particles 120 are charged negative after transfer by the preclean corotron 161. The first brush 100, in the direction of motion 16 of the photoreceptor 10, is biased positive to remove the majority (over ~90%) of the toner particles 120. The rest of the toner particles are removed by the second brush 110, located downstream from the first brush 100 in the direction of motion of the photoreceptor 10. The second brush 110 is negatively biased. The brushes 100, 110 rotate in the direction of the arrows 101, 111 respectively. Biasing the first brush 100 with a polarity opposite that of the toner particles 120 enables removal of the majority of the residual toner after transfer on the photoreceptor 10. The second brush 110 removes wrong sign toner that was not removed by the first brush 100.

The cleaning of the photoreceptor 10 is greatly affected by the biases on both cleaner brushes 100, 110. The present invention proposes monitoring the cleaner performance under artificial stress conditions that include, but are not limited to, changing brush biases and toner input to determine the photoreceptor cleaning. As a cleaner brush ages, removal of toner particles 120 from the photoreceptor 10 under stress conditions degrade and become detectable before normal cleaning becomes unacceptable. Evaluating cleaning performance under these stress conditions, using the present invention, determines when an actual cleaning failure under nominal conditions will occur prior to the observance of the actual failure by the customer. Thus, enabling corrective measures to occur before failure.

Figure 2:
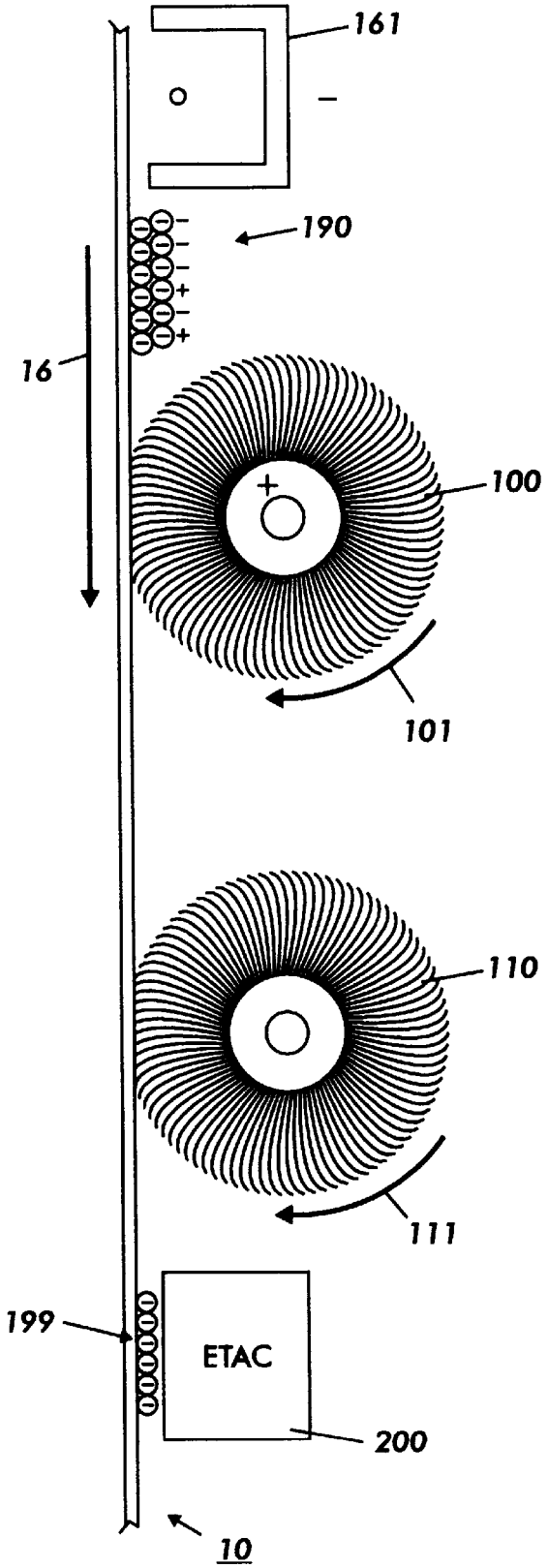
FIG. 2 is an elevational schematic of an embodiment of the present invention showing a cleaner performance monitoring system.

Reference is now made to FIG. 2 which shows an artificially stressed cleaner system and an embodiment of the present invention. In order to evaluate the cleaner under stress conditions, a sensor after the cleaner can be used to check for photoreceptor cleaning. This sensor could be an ETAC (i.e., Enhanced Toner Area Coverage) sensor. The ETAC sensor 200, ideally, would be located immediately after the cleaner as shown in FIG. 2. The ETAC sensor 200 measures the amount of toner particles on the photoreceptor 10 using reflected infra-red light. This ETAC sensor 200 can detect even very small amounts of residual toner 199 not cleaned by the cleaner system. To avoid the cost of adding an additional ETAC sensor 200 in printing machines that already use a sensor, a single ETAC sensor located in the machine could be used for multiple purposes. For purposes of the present invention, the ETAC sensor monitors the development performance and can also be used to monitor cleaner performance. Using an ETAC sensor 200 may require a temporary decrease in the print rate, if the stress condition is located on the charge retentive surface panel used for printing. If the stress condition was located in the interdocument gap, cleaning in the interdocument gap could be evaluated during normal run conditions and without decreasing the machine productivity. Thus, the artificial stress condition can be located in the printing area or the interdocument area of the photoreceptor.

Stressing the cleaner and determining the performance requires testing to correlate cleaning failures. A high DMA (Developed Mass per unit Area) untransferred control patch provides cleaning stress to the cleaner. The present invention is utilized in making the following analysis: if a stress patch 190 (e.g. a dense or solid patch of toner particles) is cleaned by the cleaner system under the normal cleaning conditions (e.g. a first brush biased with opposite polarity than the toner charge, second brush biased with opposite polarity than the first brush), then the first cleaner brush 100, which does the majority of the cleaning, is working effectively. In this embodiment of the present invention, the ETAC sensor 200 compares the photoreceptor belt reading of the stress input area to a background area. If the stress patch 190 is not removed from the photoreceptor 10, then the first brush 100 cleaning capability is decreasing. To determine how bad the cleaning is, the second brush 110 operating parameters can be changed. The second brush bias can be switched to the same polarity as the first brush bias to essentially double the cleaning capability. (For example, in FIG. 1, the second brush 110 bias would be changed from negative to positive to match the polarity of the first brush 100.) The ETAC sensor 200 then compares the post cleaner stress patch 199, reading between the +/− (first brush bias positive and second brush bias negative) and the +/+ (both brushes biased positive) operation modes. If there is a large difference, the first cleaning brush 100 is nearing the end of its brush life.

Figure 3:
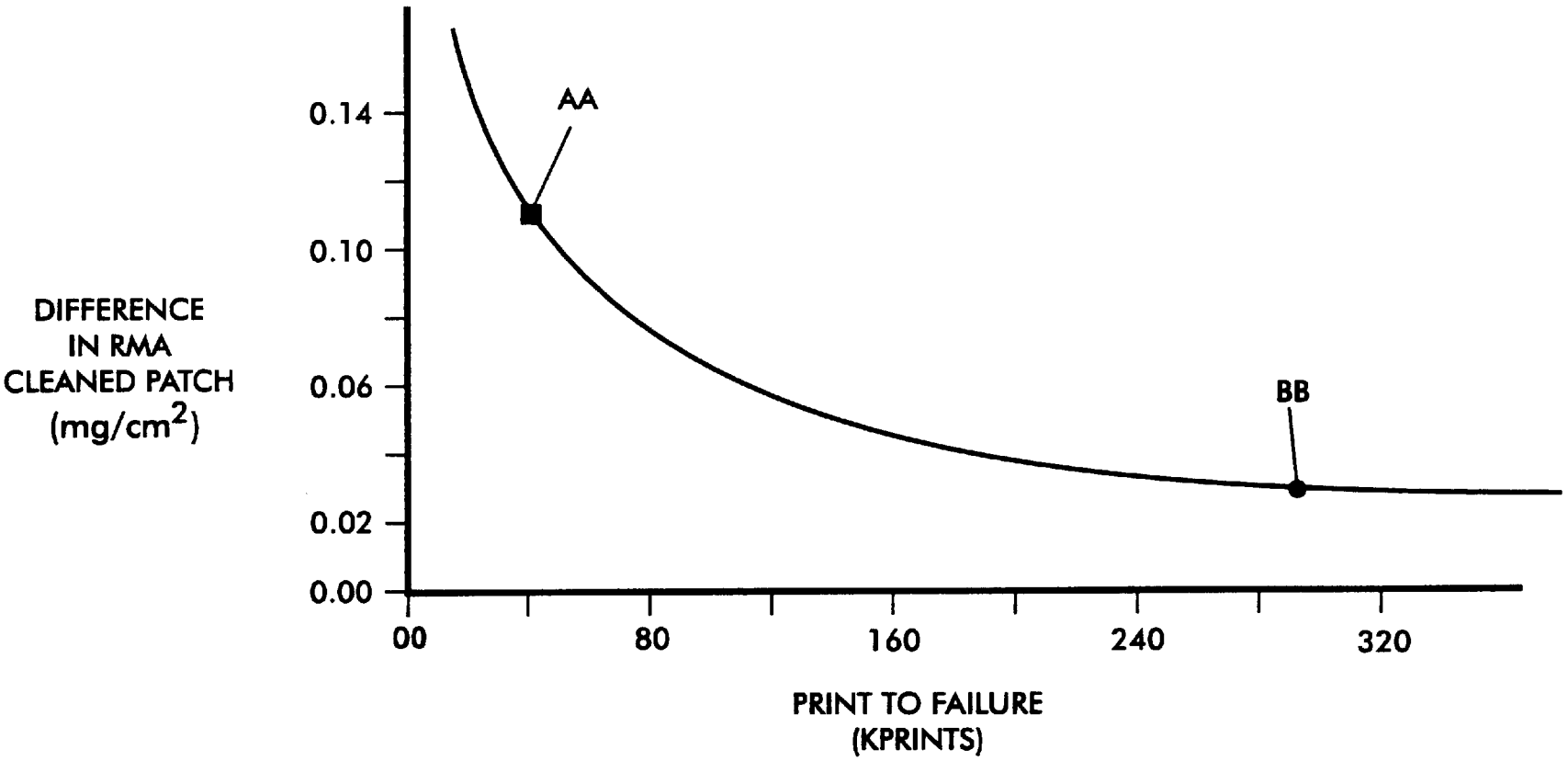
FIG. 3 is a graphical depiction of brush life using the present invention.

Reference is now made to FIG. 3 which illustrates a graph for monitoring the cleaning system and determining when a cleaning brush failure occurs. The graph shows the difference in RMA (i.e., residual mass per unit area which is the toner remaining on the photoreceptor after transfer) on the vertical axis and points to failure on the horizontal axis. When the difference between the stress and nominal cleaning residual mass is large (point AA on the graph), the cleaner brush is near the end of its brush life with approximately 45 kprint remaining. When the difference in cleaning is small (the first brush is doing all the cleaning represented by point BB), the cleaner brush is not near the end of life (~290 kprints remaining).

Other stress conditions to evaluate the cleaner performance of the cleaning system besides changing the second brush bias from negative to positive include: turning the bias of the second brush off (i.e. +/0 cleaner); disabling the second brush drive; changing the preclean corotron current (e.g. the toner could be charged to a higher average negative charge to stress the positive brush or the preclean current could be changed to positive for a short period of time to predict the second brush life); changing the brush rotational speed; or decreasing the brush biases for both brushes could be decreased to reduce the electrical forces. Any of these combinations would stress the cleaner and the sensor would determine the degradation in cleaning prior to a failure. Software applications would be used to change the cleaner settings and monitor photoreceptor cleaning.

In recapitulation, the present invention utilizes a monitoring system that includes a sensor and artificial stress conditions to determine the cleaner brush life. A comparative analysis is performed from the data provided by the monitoring system of a normal cleaning residual mass and artificial stress conditions cleaning residual mass to predict brush cleaner life reliably.

It is, therefore, apparent that there has been provided in accordance with the present invention, a monitoring system for cleaner brush life prediction that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for monitoring performance of a cleaner system removing particles from a surface of a photoreceptor, under artificial stress conditions to determine brush life, comprising:

enabling a monitoring member of the cleaner system;

creating the artificial stress conditions for the cleaner system in a non-printing area of the photoreceptor;

running the cleaner system to remove toner particles from the non-printing area of the photoreceptor under the artificial stress conditions;

using the monitoring member to determine a level of cleaning under the artificial stress conditions;

collecting data on the level of cleaning under the artificial stress conditions from the monitoring member for comparative analysis;

disabling the monitoring member to proceed with another printing run; and comparing data on the level of cleaning of the cleaner system under the artificial stress conditions to data obtained from monitoring the level of cleaning of the cleaner system under nominal conditions to determine a failure mode for the cleaner system.

2. A method as recited in claim 1, wherein the non-printing area on the surface of the photoreceptor comprises an interdocument area located between two imaging areas of the photoreceptor.

3. A method as recited in claim 1, wherein the non-printing area of the photoreceptor comprises a portion of an imaging surface not being utilized at time of monitoring performance of the cleaner system.

4. A method as recited in claim 1, wherein the step of creating the artificial stress conditions of the cleaner system comprises a stress patch on the photoreceptor in the non-printing area.

5. A method as recited in claim 4, wherein the stress patch comprises a solid patch of toner particles.

6. An electrostatographic printing machine comprising:

a charge retentive surface, capable of movement, advances past a charging station for charging of said charge retentive surface;

an exposure station through which said charge retentive surface moves, said charge retentive surface having charged portions being exposed to a scanning device that discharges said charge retentive surface forming a latent image thereon;

a development station advances toner particles into contact with the latent image on said charge retentive surface as said charge retentive surface moves through said development station;

a transfer station advances a print media for transfer of the toner particles adhered to the latent image onto the print media, the toner particles of the latent image being permanently affixed to the print media via fusing of the latent image of toner particles to the print media;

a cleaning station for removal of the toner particles remaining on said charge retentive surface after transfer, said cleaning station including: a monitoring system to determine a level of cleaning performance of a cleaning means under artificial stress conditions in a non-printing area of said charge retentive surface; and means for retrieving data from the monitoring system on the level of cleaning performance under the artificial stress conditions for comparative analysis, the comparative analysis compares data from the monitoring system on the level of cleaning performance of said cleaning station under the artificial stress conditions to data from the monitoring system on a level of cleaning performance of said cleaning station under nominal conditions to determine a cleaning station life.

7. A printing machine as recited in claim 6, wherein said artificial stress conditions comprise toner particles developed in a non-printing portion of said charge retentive surface.

8. A printing machine as recited in claim 7, wherein the non-printing portion of said charge retentive surface comprises an interdocument area located between two imaging areas on said charge retentive surface.

9. A printing machine as recited in claim 7, wherein the non-printing portion of said charge retentive surface comprises a portion of an imaging area of the charge retentive surface having no latent image during measurement of cleaning performance of said cleaning station under artificial stress conditions by said monitoring system.

10. A printing machine as recited in claim 6, wherein the artificial stress conditions of said cleaning station comprise a stress patch on a non-printing portion of said charge retentive surface.

11. A printing machine as recited in claim 10, wherein said stress patch comprises a solid patch of toner particles.

12. A printing machine as recited in claim 6, wherein said cleaning station comprises a first cleaning brush and a second cleaning brush partially extending from a cleaner housing, said first cleaning brush being located upstream from said second cleaning brush in the direction of motion of said charge retentive surface, said cleaning brushes contacting said charge retentive surface to remove particles therefrom.

13. A printing machine as recited in claim 12, wherein said cleaning brushes have a bias thereon.

14. A printing machine as recited in claim 13, wherein said artificial stress conditions comprise changing the bias on said second cleaning brush to an opposite bias as the particles after preclean.

15. A printing machine as recited in claim 6, wherein said monitoring system includes a sensing device to determine the level of cleaning performance of said cleaning station.

16. An apparatus for removing particles from a charge retentive surface, comprising:

means for cleaning particles from a charge retentive surface; and a monitoring system to determine a level of cleaning performance of said cleaning means under artificial stress conditions in a non-printing area of said charge retentive surface; and means for retrieving data from the monitoring system on the level of cleaning performance under the artificial stress conditions for comparative analysis;

the comparative analysis compares data from the monitoring system on the level of cleaning performance of said cleaning means under the artificial stress conditions to data from the monitoring system on a level of cleaning performance of said cleaning means under nominal conditions to determine a cleaning means life.

17. An apparatus as recited in claim 16, wherein said artificial stress conditions comprise toner particles developed in a non-printing portion of said charge retentive surface.

18. An apparatus as recited in claim 17, wherein the non-printing portion of said charge retentive surface comprises an interdocument area located between two imaging areas on said charge retentive surface.

19. An apparatus as recited in claim 17, wherein the non-printing portion of said charge retentive surface comprises a portion of an imaging area of the charge retentive surface having no latent image during measurement of cleaning performance of said cleaning means under artificial stress conditions by said monitoring system.

20. An apparatus as recited in claim 16, wherein the artificial stress conditions of said cleaning means comprises a stress patch on a non-printing portion of said charge retentive surface.

21. An apparatus as recited in claim 20, wherein said stress patch comprises a solid patch of toner particles.

22. An apparatus as recited in claim 16, wherein said cleaning means comprises a first cleaning brush and a second cleaning brush partially extending from a cleaner housing, said first cleaning brush being located upstream from said second cleaning brush in the direction of motion of the charge retentive surface, said cleaning brushes contacting the charge retentive surface to remove particles therefrom.

23. An apparatus as recited in claim 22, wherein said cleaning brushes have a bias thereon.

24. An apparatus as recited in claim 23, wherein said artificial stress conditions comprise changing the bias on said second cleaning brush to an opposite bias as the particles after preclean.

25. An apparatus as recited in claim 16, wherein said monitoring system includes a sensing device to determine the level of cleaning performance of said cleaning means.

* * * * *